US011358068B2

(12) United States Patent
Chutter

(10) Patent No.: US 11,358,068 B2
(45) Date of Patent: Jun. 14, 2022

(54) SAUCER AMUSEMENT ATTRACTION AND METHOD FOR MAKING THE SAME

(71) Applicant: WHITEWATER WEST INDUSTRIES LTD.

(72) Inventor: Paul Chutter, Vancouver (CA)

(73) Assignee: Whitewater West Industries, Ltd., Richmond (CA)

( * ) Notice: Subject to any disclaimer, the term of this patent is extended or adjusted under 35 U.S.C. 154(b) by 0 days.

(21) Appl. No.: 16/579,049

(22) Filed: Sep. 23, 2019

(65) Prior Publication Data

US 2020/0094155 A1 Mar. 26, 2020

Related U.S. Application Data

(60) Provisional application No. 62/735,004, filed on Sep. 21, 2018.

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
CPC ..... A63G 21/18; A63G 31/007; A63G 21/10; A63G 21/14
USPC ..... 472/117
See application file for complete search history.

(56) References Cited

U.S. PATENT DOCUMENTS

| | | | | |
|---|---|---|---|---|
| 4,149,710 | A * | 4/1979 | Rouchard | A63G 21/18 104/70 |
| 4,394,173 | A * | 7/1983 | Aste | A63G 21/06 104/69 |
| 5,738,590 | A * | 4/1998 | Lochtefeld | A63G 31/007 472/117 |
| 2002/0098895 | A1* | 7/2002 | Hagerty | A63G 21/18 472/117 |
| 2006/0128487 | A1* | 6/2006 | Johnson | A63G 3/00 472/128 |

(Continued)

OTHER PUBLICATIONS

Dolphin Plunge ("Dolphin Plunge Body Slide Both Slides (HD POVS) Aquatica Seaworld Water Park Orland"—uploaded Jan. 16, 2013 by Attraction Spot; https://www.youtube.com/watch?v=jYLTzXLyRB8) (hereinafter "Dolphin Plunge") (Year: 2013).*

*Primary Examiner* — Michael D Dennis
(74) *Attorney, Agent, or Firm* — Buchalter, a Professional Corp.

(57) ABSTRACT

A waterslide feature for providing a looping or arcuate travel path for a rider traveling thereon and method for making the same. The waterslide feature may have an entrance, an exit, and a surface (e.g., a ride surface, such as a bottom surface and/or a wall surface) therebetween comprising a transparent and/or semi-transparent surface configured to permit the rider to see through the surface and experience an exterior environment. Spectators or bystanders to the waterslide feature may be able to see through the surface and to witness riders riding upon the waterslide feature. The waterslide feature may be oriented at an angle to horizontal (e.g., tilted) and/or may be positioned within a defined exterior environment contained within an exterior wall. The exterior wall may be configured to retain water such that at least a portion of the waterslide feature is below the height of the water.

12 Claims, 8 Drawing Sheets

(56) References Cited

U.S. PATENT DOCUMENTS

| | | | | |
|---|---|---|---|---|
| 2009/0075740 | A1* | 3/2009 | Kojro | A63G 3/06 472/45 |
| 2010/0016091 | A1* | 1/2010 | Brassard | A63G 21/18 472/117 |
| 2011/0177872 | A1* | 7/2011 | Hunter | A63G 21/18 472/117 |
| 2012/0277011 | A1* | 11/2012 | Hunter | A63G 21/18 472/88 |
| 2017/0106295 | A1* | 4/2017 | Hunter | A63G 21/14 |

* cited by examiner

SAUCER AMUSEMENT ATTRACTION AND METHOD FOR MAKING THE SAME

CROSS REFERENCE TO RELATED APPLICATIONS

This application claims the benefit of U.S. Provisional Patent Application Ser. No. 62/735,004 filed on Sep. 21, 2018, entitled "SAUCER AMUSEMENT ATTRACTION AND METHOD FOR MAKING THE SAME," which is hereby incorporated by reference in its entirety into this application.

BACKGROUND

1. Field of the Invention

The present invention relates to an amusement attraction apparatus and method. More particularly, the present invention relates to a water ride attraction and method whereby riders to travel thereon in a looping travel path and/or in or through an unique environment, such as a transparent or partially translucent structure.

2. Description of the Related Art

Waterslide attractions typically provide riders with a thrilling experience of speed and lateral force upon the body as the riders slide on the attraction. A stream of water is commonly flowed along a flume from an entrance location to an exit location. A rider slides along the flume due to the stream of water, either with or without a ride vehicle, and experiences excitement as they travel from the entrance location to the exit location along with the flow of water. One type of water ride includes a riding surface in the shape of a bowl that is positioned horizontally upon the ground or other surface, whereby a rider enters the bowl along a side of the bowl and exits via an opening in the bottom of the bowl. For example, a pool of water may be positioned underneath the bowl such that a rider falls through the opening in the bottom of the bowl and splashes into the pool of water below. Water parks and other facilities containing waterslide attractions often must regularly introduce new water rides or in order to maintain customer appeal and interest.

An improved waterslide or method for making a waterslide or other amusement attraction that introduces new concepts, features, or slide experiences for a rider and/or spectator to the attraction is desired. Such an improved waterslide may provide riders with a ride experience that such riders and/or spectators have not encountered before, thereby driving excitement and sales at locations, such as waterparks, which install such a waterslide. The improved waterslide would ideally contain one or more novel slidepaths that a rider would travel while riding upon the waterslide. The improved waterslide would ideally be visually interesting for spectators and/or riders.

SUMMARY

The present invention is related to a method and apparatus relating to a saucer or other looping water or non-water based feature or attraction. Exemplary embodiments may be used to provide unique ride experiences. For example, the saucer may be transparent or semi-transparent to permit the user to experience and see different external environments. Exemplary embodiments may locate the saucer within different environments to provide external visual effects. For example, the saucer may be located fully or partially under water, within a terrarium, within a greenhouse, within an animated environment, without a set, and combinations thereof.

In an exemplary embodiment, a saucer waterslide feature may include providing a providing an entrance, connected with the ride surface, for a rider to enter onto the ride surface, providing an exit, connected with the ride surface, for a rider to exit from the ride surface, and moving the rider in a looping travel path covering substantially 360 degrees from the entrance to the exit. The travel path may be generally circular, ovoid, spiral, or other shapes as dictated by the ride shape, entrance location relative to the saucer, exit location relative to the saucer, and ride surface.

In another exemplary embodiment, the saucer may be flat or tilted. In one embodiment, a waterslide feature may include a tilted ride surface for supporting a rider thereon, an entrance, connected with the ride surface, for providing a rider onto the ride surface, an exit, connected with the ride surface, for receiving a rider from the ride surface, wherein the ride surface is configured to cause the rider to travel in a looping travel path from the entrance to the exit.

Another exemplary embodiment includes a method for providing a waterslide feature providing an entrance configured to receive a rider; providing an exit configured to discharge the rider; providing a ride surface that extends between the entrance and exit; and wherein the ride surface is configured to support the rider and permit the rider to see a portion of an exterior environment through a surface of the ride.

In one embodiment, a waterslide feature may include an entrance configured to receive a rider, an exit configured to discharge the rider, a ride surface extending between the entrance and exit and configured to support and cause the rider to travel along an arcuate travel path from the entrance to the exit, and an elevated portion connected with the ride surface and adjacent to the entrance and the exit, the arcuate travel path extending at least partially around the elevated portion. The ride surface may be at least partially formed of a transparent material permitting the rider to see through the transparent material.

In one embodiment, a waterslide may include a body of water. A waterslide feature may include an entrance, an exit, and a ride surface connecting the entrance and exit, wherein a rider is configured to travel from the entrance to the exit by riding along an arcuate travel path on the ride surface. The waterslide feature may be at least partially disposed beneath a surface of the body of water.

In one embodiment, a waterslide may include a body of water. A waterslide feature may include an entrance, an exit, and a ride surface connecting the entrance and the exit. The ride surface may be at least partially made of a transparent material and a rider may be permitted to ride from the entrance to the exit along an arcuate travel path on the ride surface. The waterslide feature may be at least partially disposed beneath a surface of the body of water.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1A:
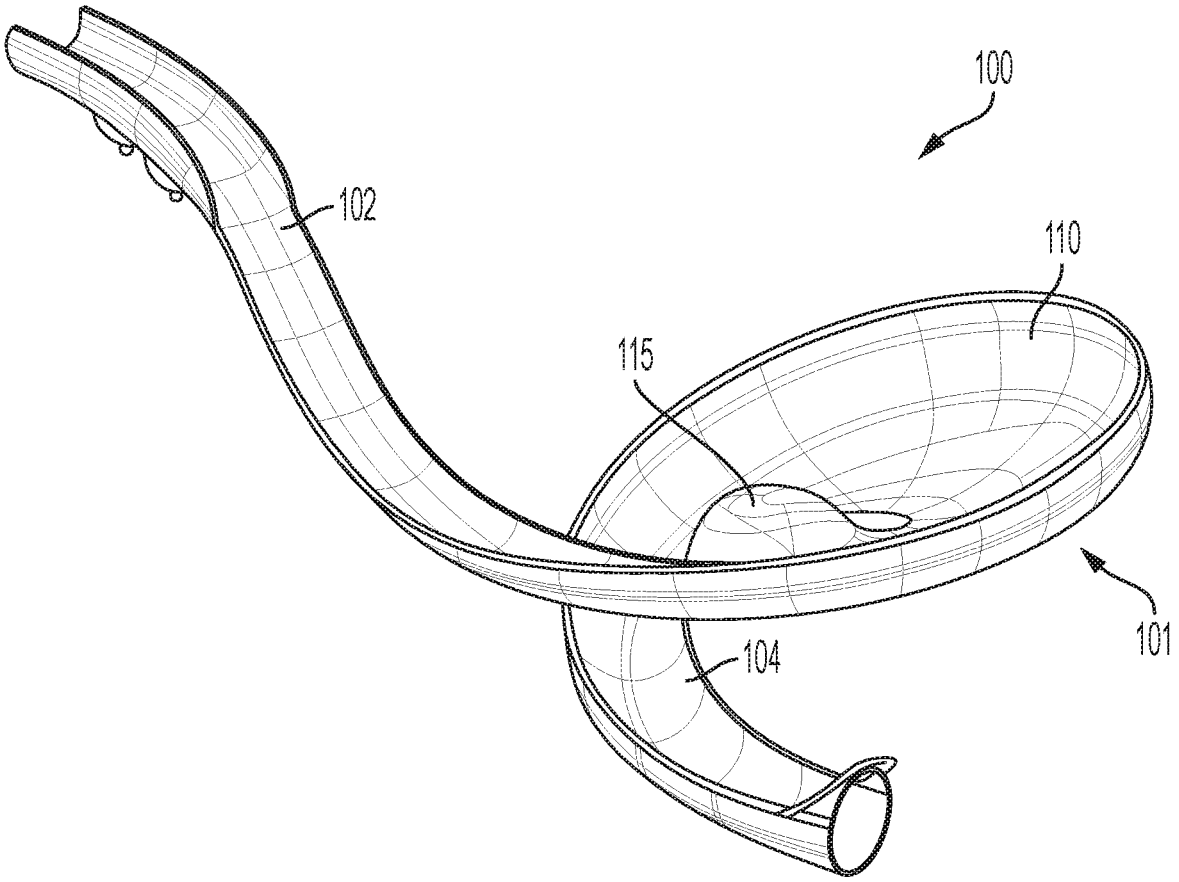
FIG. 1A illustrates a perspective view of a waterslide feature, according to one exemplary embodiment of the present invention.

FIG. 1A shows a perspective view 100 of a waterslide feature 101. The waterslide feature 101 may be connected as part of a larger waterslide (e.g., connected before and/or after other features or a waterslide, for example via slides, flumes, tubes, drops, etc. such that a rider may consecutively ride through one or more features of a waterslide, including the waterslide feature 101. Although specifically illustrated as having one particular shape, configuration, and/or orientation in FIG. 1A, the waterslide feature 101 may have other shapes, configurations, and/or orientations, as described in greater detail herein for FIG. 1A and/or for the other figures of this application, in alternative embodiments.

The waterslide feature 101 includes an entrance 102 for permitting rider entry into the waterslide feature 101. The entrance 102 may include any of a variety of possible manners or structures for a rider to enter into the waterslide feature 101, such as an open flume, closed flume, slide, drop, etc. Likewise, the waterslide feature 101 includes an exit 104 for permitting rider exit from the waterslide feature 101. The exit 104 may include any of a variety of possible manners or structures for a rider to enter into the waterslide feature 101, such as an open flume, closed flume, slide, drop, etc. The entrance 102 and the exit 104 may be the same type of structure (e.g., both flumes) for permitting rider travel or may be different structures (e.g., the entrance 102 may be a flume while the exit 104 may be a vertical drop from an open portion or hole of the waterslide feature 101.)

Figure 1B:
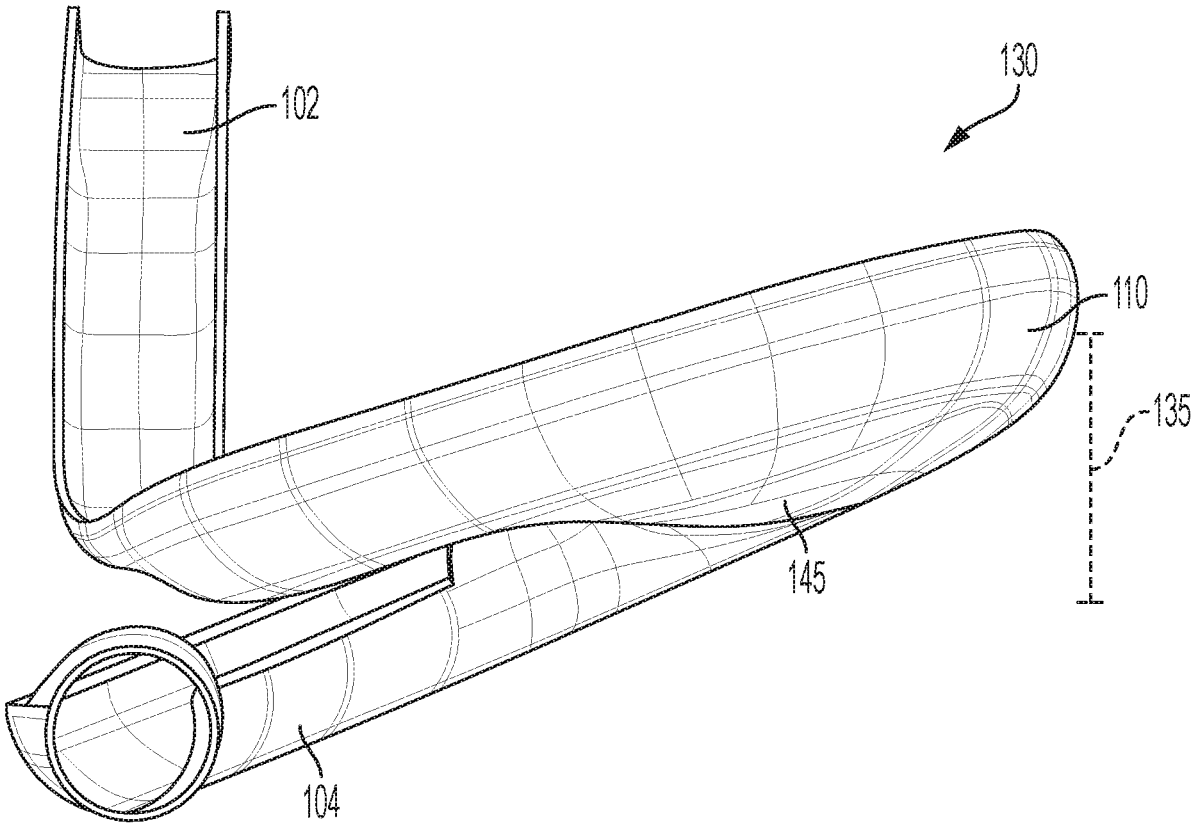
FIG. 1B illustrates a side view of the waterslide feature of FIG. 1A, according to one exemplary embodiment of the present invention.
Figure 1C:
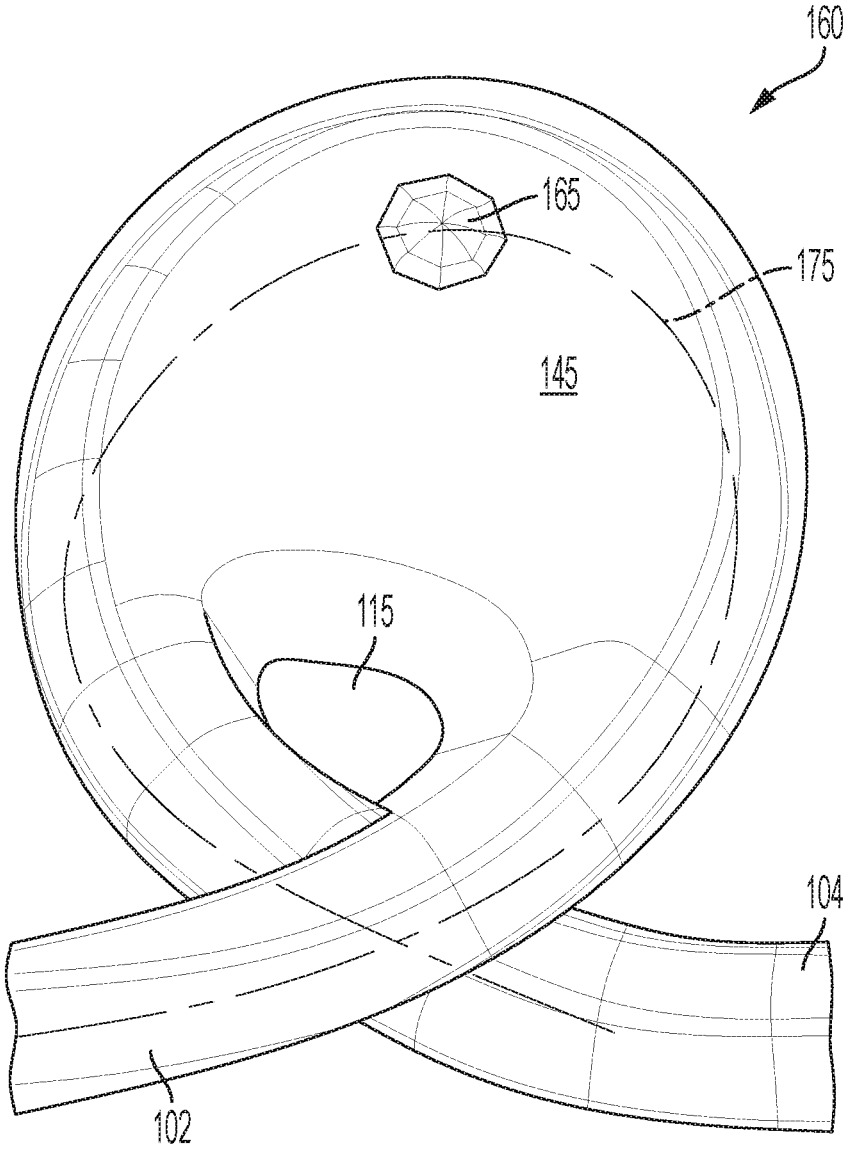
FIG. 1C illustrates a zoomed, top view of the waterslide feature of FIG. 1A showing a possible slide path for a rider, according to one exemplary embodiment of the present invention.

The waterslide feature 101 may include a wall portion 110 that is substantially shaped such that the waterslide feature 101 forms the shape of a bowl, circle, oval, sphere, saucer, or other shape or configuration such that a rider is permitted to travel along an arced travel path upon one or more surfaces (e.g., curved surfaces) of the waterslide feature 101 from the entrance 102 to the exit 104. An elevated surface or portion 115 is disposed adjacent to the entrance 102 and/or exit 104 such that a one or more riders (e.g., upon ride vehicles or without ride vehicles) may ride, slide, or otherwise travel in an arcuate path around the elevated surface or portion 115. FIG. 1B shows a side view 130 of the waterslide feature 101 of FIG. 1A and shows a riding surface (e.g., curved or contoured) that extends from the wall portion 110. A rider may be permitted to ride upon the riding surface 145 alone and/or upon the wall portion 110 while traversing the waterslide feature 101 from entrance 102 to exit 104. The waterslide feature 101 may also be oriented such that one end of the waterslide feature 101 is elevated 135 from the horizontal (e.g., 20 degrees). Such an elevation may aid in the enjoyment of a rider traversing the waterslide feature 101 and/or help define the desired travel path for the rider from entrance 102 to exit 104. For example, FIG. 1C shows a zoomed, top view 160 of the waterslide feature 101 discussed for FIGS. 1A-B and shows a possible travel path 175 for one or more riders 165 that is traversing the waterslide feature 101. The travel path 175 may vary, for example, depending upon weight of the one or more riders 165, speed or volume of water flowing on the waterslide feature 101.

The waterslide feature 101 of FIGS. 1A-C may be formed of any of a variety of possible materials, including plastics, fiberglass, metal, etc. In one embodiment, the waterslide feature 101 may be fully or partially formed of a material that is fully or partially transparent or translucent. For example, such a waterslide feature 101 may be constructed with such transparent or translucent materials such that the waterslide feature 101 allows for riders to see an environment outside of the waterslide feature 101 while traveling on the waterslide feature 101 and/or spectators or bystanders that are not riding on the waterslide feature 101 may be able to see the riders and/or other features of the waterslide feature 101 through such transparent or translucent materials. The waterslide feature 101 can be placed fully or partially underwater (e.g., in a pool, lake, or other body or volume of water where other persons are permitted to swim or otherwise congregate) and/or made with transparent or translucent materials, giving the appearance of the waterslide feature 101 being an aquarium and/or fishbowl.

Figure 2:
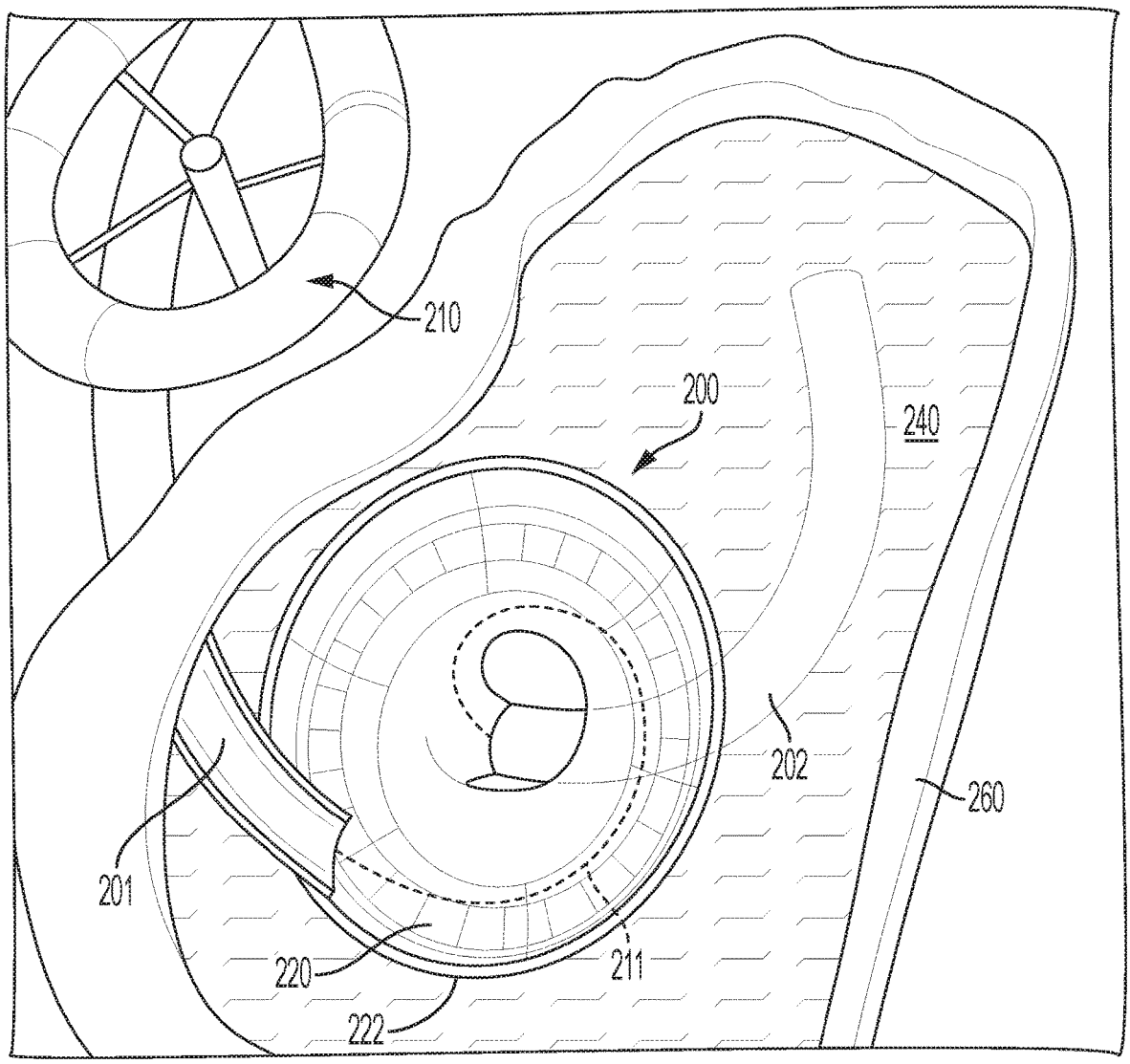
FIG. 2 illustrates a top view of a waterslide feature connected as part of a waterslide environment, according to one exemplary embodiment of the present invention.

FIG. 2 shows a top view of a waterslide feature 200 connected as part of a waterslide environment. The waterslide feature 200 allows for at least one rider (not shown) to ride or travel upon one or more surfaces of the waterslide feature 200. The at least one rider may ride upon the waterslide feature 200 via a ride vehicle (e.g., foam pad, inflatable device, etc.) and/or may ride upon the waterslide feature 200 without any ride vehicle in alternative embodiments. The waterslide feature 200 may include features that are the same as or similar to those discussed throughout this application. In one embodiment, as shown, the waterslide feature 200 may be defined as a generally bowl shaped, or defining a greater cross dimension as the one or more entrances and/or exits into or out of the waterslide feature 200. However, exemplary embodiments may be used in which the waterslide feature 200 is merely an extension of an entrance or exit. The waterslide feature 200 may be any rideable surface or portion of a water amusement park. Exemplary embodiments are also not so limited to water attractions, but may be equally applicable to other amusement rides.

In one embodiment, as shown in FIG. 2, the waterslide feature 200 may be incorporated within a larger waterslide attraction (e.g., is one sliding feature among one or more other features 210 that are encountered by the at least one rider as the at least one rider travels, rides, and/or slides along a full travel path from an initial entrance of the larger waterslide attraction to a final exit of the larger waterslide attraction. Other shoots, slides, flumes, ride paths, tubes, surfaces, etc. and/or combinations thereof may be included to create an entire ride experience. In another embodiment, the waterslide feature 200 may be the only or substantially the only feature making up the waterslide attraction such that the waterslide feature 200 is the waterslide attraction itself. As discussed in greater detail herein, the larger waterslide and/or the waterslide feature 200 may include additional or alternative ride surfaces that extend through, originate at or in, or terminate at or in an exterior environment (e.g., a water environment) created by an exterior wall. In one embodiment, such exterior environment may house creatures, visual effects, objects, and/or other features to create an engaging and/or exciting experience of the external environment that may be viewed by riders as they pass along the ride surface of the waterslide feature. In one embodiment, the waterslide feature 200 may be provided in combination with other waterslide attractions, such that the waterslide feature 200 and one or more other waterslide attractions or features share common features, such as a splash pool used as a final exiting feature after riders traverse the waterslide feature, etc. In one example, an external water environment of waterslide feature 200 may be used as a splash pool of another waterslide attraction or feature.

As illustrated in FIG. 2, an entrance flume or slide 201 may connect with the waterslide feature 200 in order for the at least one rider traveling along and/or within the entrance flume or slide 201 to enter into the waterslide feature 200. Although a flume is specifically illustrated in FIG. 2, any of a variety of possible entrances may be used in alternative embodiments (e.g., open slides, free-falling drops, etc.). Indeed, in a non-waterslide context, any of a variety of possible manners for introducing at least one rider may be used, such as stairs, walkways, vehicles (e.g., upon a track or rail), etc. If the waterslide feature 200 is incorporated as part of a larger waterslide attraction, the entrance flume or slide 201 may be connected to other, prior waterslide features (e.g., other waterslide features that are the same as, similar to, or different from waterslide feature 200 to create a sequential travel path through multiple waterslide features). For example, in an embodiment, different waterslide features (e.g., corkscrews or any of a variety of other elements) may be used.

Similarly, an exit flume or slide 202 may connect with the waterslide feature 200 in order for the at least one rider traveling on the waterslide feature 200 to exit from the waterslide feature 200 and travel to an exit for the waterslide or be transported to further elements of the waterslide. Although a flume is specifically illustrated in FIG. 2 for the exit flume or slide 202, any of a variety of possible exits may be used in alternative embodiments (e.g., open slides, vertical drops, etc.). Moreover, although only one entrance flume or slide 201 and one exit flume or slide 202 are shown in FIG. 2 alternative embodiments may use any of a variety of numbers of entrances and/or exits.

The waterslide feature 200 may be shaped in any of a variety of ways, such as a bowl, a sphere or part of a sphere, or any of a variety of other possible shapes (e.g., shapes having angled walls instead of curved or smooth surfaces). As shown in FIG. 2, the waterslide feature 200 may include a body made up of a ride surface portion 220 and an exterior wall 222 that extends upwardly from the ride surface portion 220 at or along a border or perimeter of the ride surface portion 222. The ride surface portion 220 and/or the exterior wall 222 may be any of a variety of shapes or configurations, such as flat or substantially flat, curved, angled, horizontal, vertical, etc. In certain embodiments, there may be no difference or demarcation between the ride surface portion 220 and the exterior wall 222 such that there is a single, smooth and/or uninterrupted surface comprising both the ride surface portion 220 and the exterior wall 222 (e.g., a smooth bowl, sphere, etc.).

A travel path 211 for the at least one rider is shown in FIG. 2 for the waterslide feature 200. In one embodiment, the travel path 211 may extend from an opening of the entrance flume or slide 201, around all or a portion of the ride surface portion 220 of the waterslide feature 200, and then into an opening of the exit flume or slide 202. Although an exemplary looping and/or spiral travel path 211 is specifically shown in FIG. 2 (e.g., whereby the at least one rider may travel along the waterslide feature 200 on the ride surface portion 220), in an alternative embodiment, the at least one rider may travel on a travel path that extends across other surfaces (e.g., the exterior wall 222) of the waterslide feature 200. The travel path 211 may take the rider on a substantially 360-degree looping travel path. In an alternative embodiment, the travel path 211 of the waterslide feature 200 may vary and form any desired travel path (e.g., less than or greater than 360 degrees, vertical, horizontal, etc.). For example, this may be accomplished by altering the positioning of connection of either or both of the entrance flume 201 and/or the exit flume 202 with the waterslide feature 200 and/or by positioning and/or tilting the waterslide feature 200 in differing configurations.

The travel path 211 may be predetermined for the at least one rider, for example via the establishment of a guide, channel, or other depression within a surface (e.g., ride surface portion 220) of the waterslide feature 200. This guide may be formed, in one embodiment, such that one or more walls or elevated portions (e.g., ridges, hills, bumps, etc.) act to maintain the rider within a particular area of the surface such that the travel path 211 is known and/or pre-established for the rider. In exemplary embodiments, the guide may be established via other manners, for example, usage of materials and/or coatings having different coefficients of friction in order to cause the rider to be maintained in a predetermined part of the waterslide feature 200. In such an embodiment, the rider enjoyment and/or predictability of ride operation may be better maintained since the positioning of the rider on the waterslide feature 200 is already planned. In another exemplary embodiment, the travel path 211 may not be predetermined, allowing for the rider to travel in a variety of travel paths which may differ on a given ride upon the waterslide feature 200 depending upon any of a variety of possible inputs or circumstances(e.g., rider weight, water velocity, water volume, rider positioning, number of riders, etc.). In one embodiment, the ride surface portion 220 along which the one or more travel path 211 for a given rider occurs may be curved (e.g., as opposed to flat or substantially planar).

One or more surfaces (e.g., ride surface portion 220 and/or exterior wall 222, etc.) of the waterslide feature 200 may be made of any of a variety of materials (e.g., fiberglass, acrylic, plastic, ceramic). In an exemplary embodiment, the waterslide feature 200 includes one or more transparent and/or semi-transparent portions. The transparent or semi-transparent portion may be on a portion of the ride surface 220, exterior wall 222, and/or any combinations thereof. Exemplary embodiments are configured such that the one or more riders and/or spectators of the waterslide feature 200 may see through all or a portion of the waterslide feature 200 (e.g., riders may view an environment outside of the waterslide feature 200 and/or spectators may view an environment within the waterslide feature 200, such as the riders themselves traveling along the travel path 211). In exemplary embodiments, any combination of the entrance flume or slide 201, exit flume or slide 202, and/or other portions or surfaces of the waterslide feature 200, including its entirety, may be made of a transparent and/or semi-transparent material or materials.

The waterslide feature 200 may be partially or fully enclosed in one or more directions within an exterior environment 240. The environment may be visible through the one or more transparent and/or semi-transparent surfaces such that the one or more riders may see and experience the exterior environment 240. For example, as specifically shown in FIG. 2, the exterior environment 240 may be a water environment, for example contained by a wall surface 260 (e.g., a contained body of water such as a pool). The exterior environment 240 may be created, retained, and/or defined by the wall surface 260. The wall surface 260 may be positioned above a portion of the waterslide feature 200. A top of the wall surface 260 may be positioned at a height above a portion (e.g., a majority or substantial majority) or all of the waterslide feature 200 (e.g., all of some of the ride surface portion 220, the exterior wall 222, etc.). The wall surface 260 may be configured to retain water and create a water environment that is viewable by riders of the waterslide feature 200. In certain embodiments, spectators may be permitted to be in the exterior environment 240 (e.g., the water environment) and view riders on the waterslide feature 200 (e.g., by way of a transparent or semi-transparent material making up at least a portion of the waterslide feature 200).

The exterior environment 240 may include spray or other entertainment features that may include one or more conduits (e.g., pipes, nozzles, troughs, waterfalls, etc.) that are configured to spray or otherwise dispose water onto at least a portion of a surface of the waterslide feature 200. This disposal of water may be configured to dump or spray upon the one or more riders of the waterslide feature 200 as they traverse the ride and/or may be used to provide additional waterflow upon the waterslide feature (e.g., to aid in establishing or providing a travel path for riders as they traverse the waterslide feature). Although a specific water spray feature having a particular orientation, positioning, and/or operation is not explicitly illustrated in FIG. 2, any of a variety of possible water features (e.g., waterfalls, spouts, guns, etc.) may be used in varying embodiments.

The wall surface 260 may be configured to retain water about a portion of the waterslide feature 200. The wall surface 260 may include one or more apertures for permitting ingress and/or egress of passages to or from the waterslide feature 200, such as the entrance flume 201 or exit flume 202. The height of the wall surface 260 may be higher than the ride surface 220 of the waterslide feature 200 such that the wall surface 260 may contain water to a level above the ride surface and permit water contact to portions of the waterslide feature 200 (e.g., including portions of the exterior wall 222). In an exemplary embodiment, the wall surface 260 may be configured to retain water in and/or to define an exterior environment 240 in contact with the waterslide feature 200. In one embodiment, the waterslide feature 200 may be fully or partially submerged under water of the exterior environment 240.

As shown in FIG. 2, the waterslide feature 200 may have having an exterior perimeter entrance and central exit configuration and/or having the ride surface portion 220 substantially or generally in a circular or oval in shape with the wall surface 222 defining a substantially or generally toroidal area. The waterslide feature 200 may includes a central opening at, in, and/or through the middle of the ride surface portion 220 to accommodate the exit flume or slide 202. Other entrance/exit configurations may be used (e.g., such as a side-by-side entrance/exit configuration and/or other manners of causing rides to enter and/or exit different from a flume or slide, etc.) in alternative embodiments. For example, an entrance opening for the entrance flume or slide 201 and an exit opening for the exit flume or slide 202 may be oriented and/or positioned with respect to one another in a side-by-side configuration, whereby the entrance opening and the exit opening are next to or adjacent to one another along an outer perimeter of the waterslide feature (e.g., may not be overlapping one another, such that the entrance flume or slide 201 or its corresponding entrance opening does not obscure the exit opening when viewed from a top perspective). The entrance opening and the exit opening may be oriented with respect to one another in an interior/exterior configuration, whereby the entrance opening is positioned next to or adjacent an exterior edge of the waterslide feature 200 and the exit opening is positioned on an interior portion of the waterslide feature 200. Other exemplary entrance/exit configurations may include over-under entrance/exit configuration (e.g., whereby the entrance opening is positioned above the exit opening, either in an overlapping fashion such that the entrance flume or slide 201 or its corresponding entrance opening obscures the exit opening when viewed from a top perspective or in a non-overlapping fashion).

Although a specific embodiment has been illustrated having particular dimensions and/or configurations in FIG. 2 for the waterslide feature 200, any of a variety of other possible features or functionality may be included and/or removed from a waterslide feature in other embodiments. For example, although the waterslide feature 200 showcases a saucer or bowl configuration with an open top, an alternative embodiment may be a fully enclosed waterslide feature (e.g., a closed saucer, bowl, sphere, etc.). Likewise, a waterslide feature may include additional functionality, such as lighting characteristics, that may add to rider or spectator enjoyment. For example, lights (e.g., light-emitting diodes) may be connected with and/or implanted within or underneath one or more surfaces (e.g., the ride surface portion 220, exterior wall 222, wall surface 260, or exterior environment 240) of the waterslide feature 200 and its environment. Such lighting may be configured to illuminate through one or more of the surfaces (e.g., transparent or semi-transparent surfaces) of the waterslide feature 200. For example, lighting may be configured to illuminate portions of the exterior environment 240 visible through the one or more transparent or semi-transparent surfaces for the rider (e.g., may illuminate prior to, during, and/or after the rider has travelled upon the corresponding surface). Sound and/or tactile features (e.g., vibration, etc.) may additionally be used in certain embodiments of the waterslide feature 200 in addition to, or in replacement of lighting features.

Figure 3:
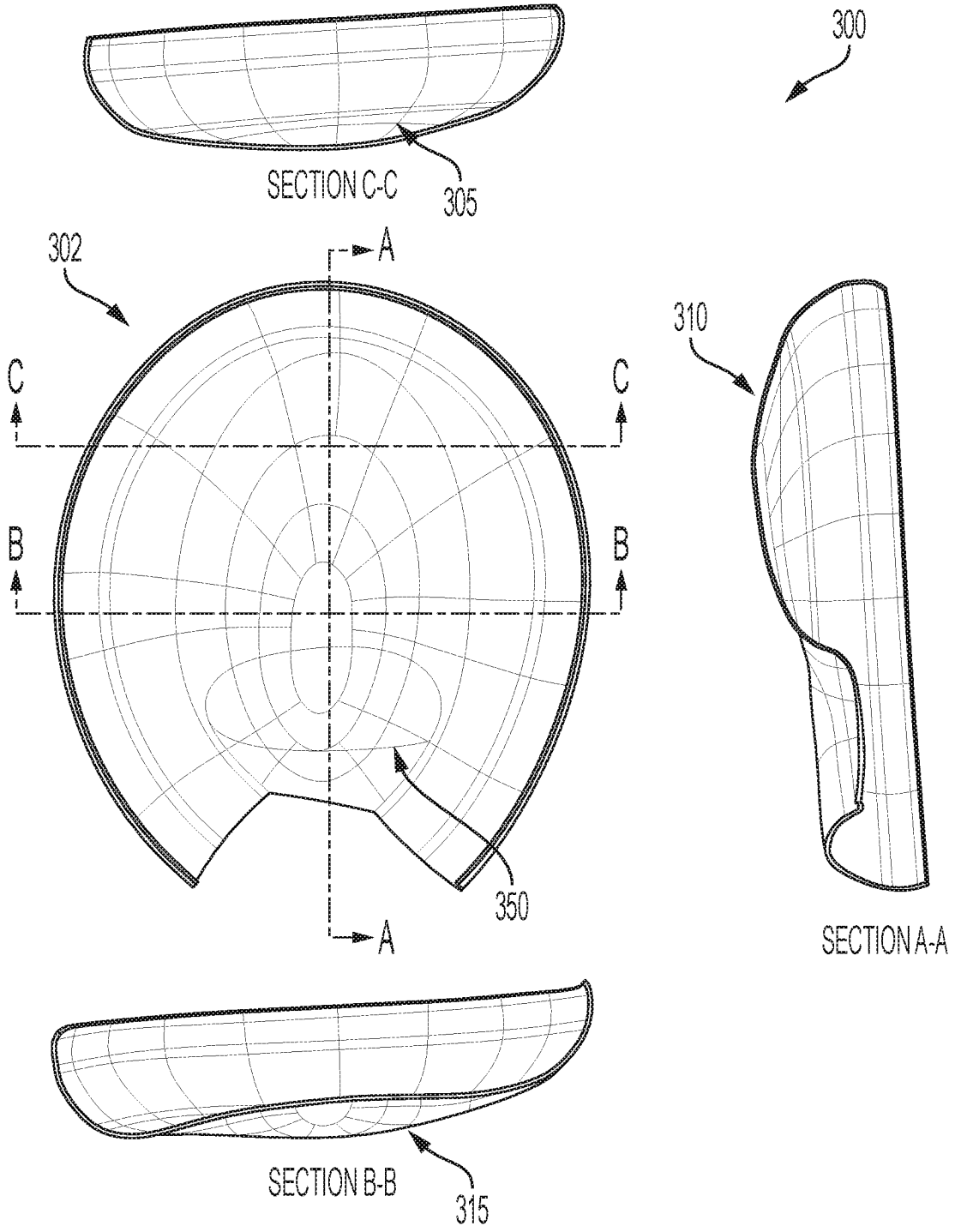
FIG. 3 illustrates multiple views of a waterslide feature, according to one exemplary embodiment of the present invention.

FIG. 3 shows multiple views 300 of a waterslide feature 302. The waterslide feature 302 may include features that are the same as or similar to those discussed throughout this application. The waterslide feature 302 includes a surface configured to be ridden upon by a rider (e.g., by sliding or riding upon a flow of water). The rider may ride upon the waterslide feature 302 in a looping and/or arcuate travel path, for example as previously discussed. In one embodiment, an upwardly extending portion 350 may provide a structure for the rider to traverse around on their looping travel path along the waterslide feature 302. Sectional views (305, 310, 315) show the waterslide feature 302 along each of Sections C-C, A-A, and B-B, respectively to illustrate one possible embodiment for a shape or configuration of the waterslide feature 302.

Figure 4A:
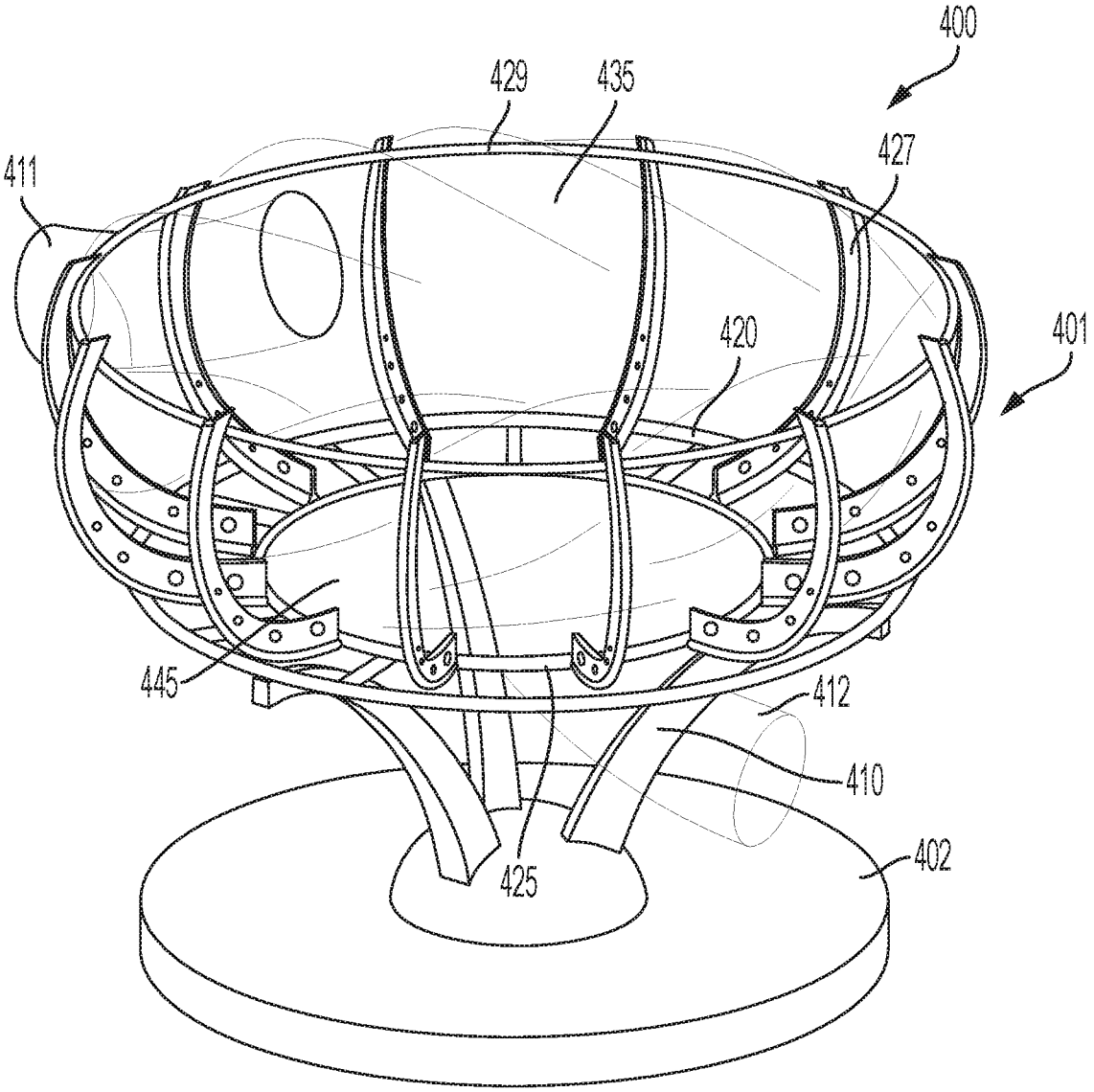
FIG. 4A illustrates a perspective view of a waterslide feature and supporting structure, according to one exemplary embodiment of the present invention.
Figure 4B:
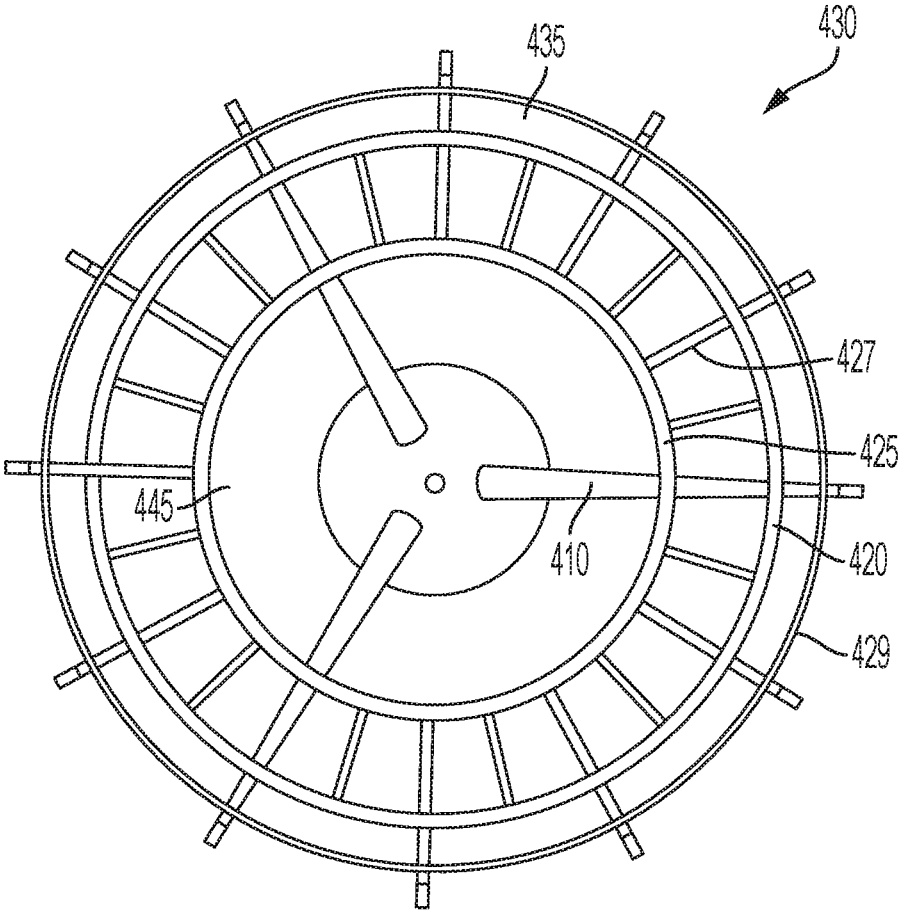
FIG. 4B illustrates a top view of the waterslide feature and supporting structure of FIG. 4A, according to one exemplary embodiment of the present invention.
Figure 4C:
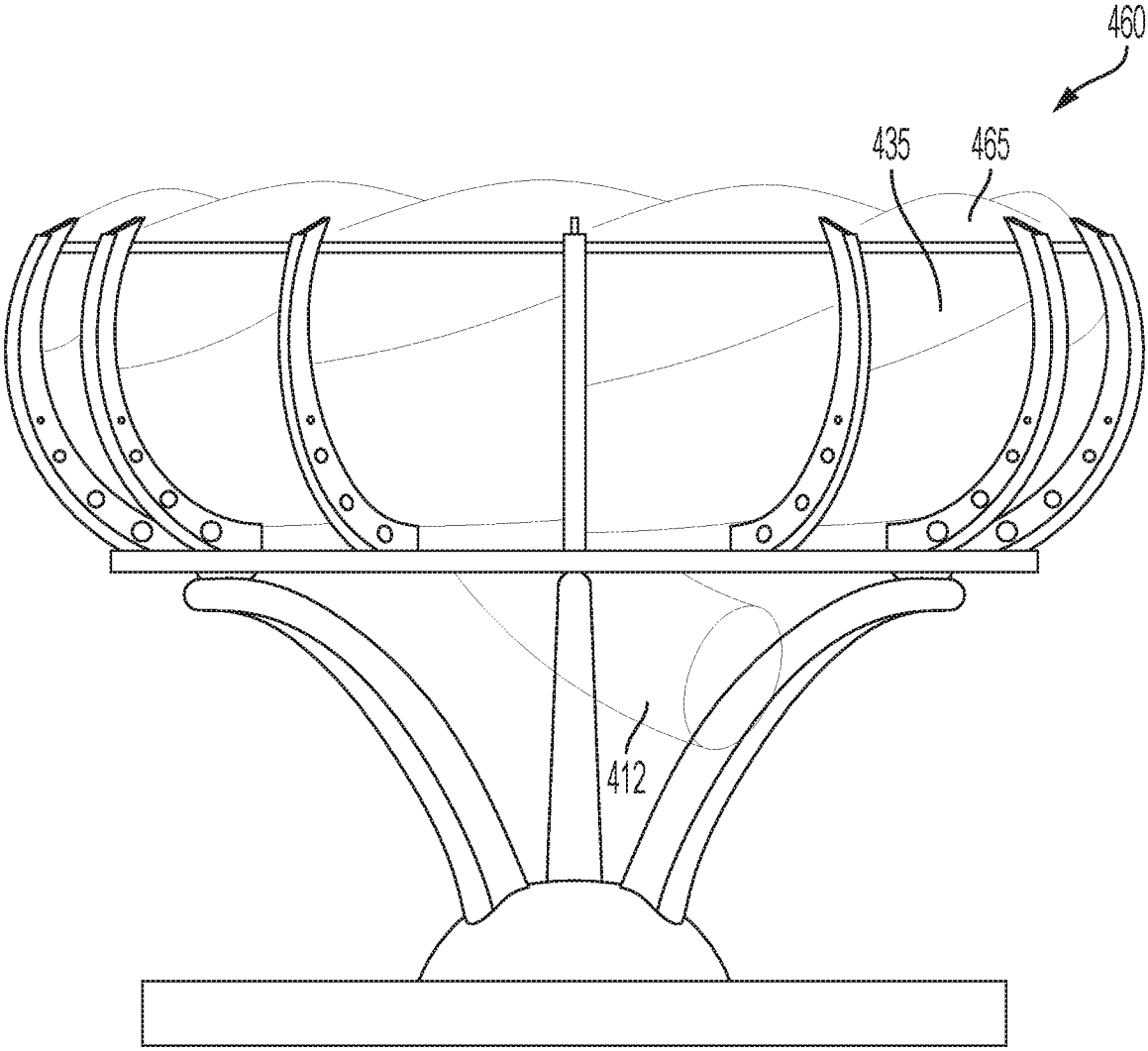
FIG. 4C shows a side view of the waterslide feature and supporting structure of FIG. 4A, according to one exemplary embodiment of the present invention.

FIGS. 4A-4C illustrate an exemplary support configuration for a waterslide feature according to embodiments described herein. The waterslide feature with supporting structure 401 may include features that are the same as or similar to those discussed throughout this application. FIG. 4A shows a perspective view 400 of the waterslide feature with supporting structure 401. As shown, the waterslide feature with supporting structure 401 may include an entrance 411 for allowing a rider to enter onto or into a bottom surface 445 and a wall surface 435 circumscribing an exterior perimeter of the bottom surface 445, as described in more detail herein. In certain embodiments, both the bottom surface 445 and the wall surface 435 may allow for rider traversal thereof, for example, in a looping or arced travel path. An exit 412 allows for the rider to exit from the bottom surface 445 and/or the wall surface 435 in order to exit from the waterslide feature with supporting structure 401.

The wall surface 435 may be interrupted, include, and/or encompass the entrance 411 and/or the exit 412. In an exemplary embodiment, the wall surface 435, with or without the entrance 411 and/or exit 412, may define a bander extending from the bottom surface 445 upward to separate the bottom surface 445 from an exterior environment. As described herein, the exterior environment may include water (e.g., may be a pool, lake, etc.). In such a configuration, the wall surface 435, with or without the entrance 411 and/or exit 412, may define a liquid barrier such that water from the exterior environment is kept out of contact from the bottom surface 445.

As seen in FIG. 4A-C, a portion of the wall surface 435 may be concave inward toward the ride surface (e.g., toward a center of the ride surface and/or waterslide feature). The outside of the wall surface 435 may therefore define a curved surface approximate to a portion of a sphere or three dimensional ovoid. The wall surface 435 may include portions for ingress and/or egress such as through entrance flume and/or exit flume. An entrance may be an opening and/or extension above the ride surface and an exit may be an opening and/or extension below the ride surface. The wall surface 435 may curve to such an extent that it extends centrally and over a portion of the ride surface. The design and shape of the wall surface 435 extending into an overhang may be used to create and/or define different water structures for use with riders along the ride path.

For example, when the waterslide feature is immersed (e.g., fully or partially) in water of an exterior or surrounding environment (e.g., a pool, lake, etc.), the water level of the exterior environment may come to or near a top of a portion of the wall surface 435 and/or the overhang such that water from the exterior environment is selectively allowed to pour or otherwise be allowed into the ride area over and/or through the wall surface 435, thereby creating waterfalls and/or other water features. The wall surface 435 may be contoured, defined, shaped, and/or elevated to create various experiences including rides surfaces and/or water features. For example, a portion of the wall surface 435 may be sufficiently high that water is not permitted to enter the ride surface around a majority of the waterslide feature, but may be permitted to selectively enter at a location along the ride path (e.g., due to a lower height for the wall surface 435 at that position, an opening in the wall surface 435 at that position, etc.). The wall surface 435 may extend over the ride path and create a radial overhang such that water is permitted to spill from the overhang along a radial distance across a travel path for a rider.

As seen in FIGS. 4A-C, the waterslide feature with supporting structure 401 may include a plurality of connected beams, poles, posts, or other structural element(s), as discussed in greater detail herein, that are configured to configure and/or orient the waterslide feature in an elevated, yet stable, configuration. Any of a variety of potential angles of tilt may be used in differing embodiments. Although certain embodiments specifically illustrated in this application show a waterslide feature located in close proximity to a ground, in alternative embodiments shown in other figures herein, waterslide feature may be disposed at any of a variety of elevations (e.g., sunken into the ground and/or elevated higher in the air).

For example, as shown in FIG. 4A, a supporting frame for elevating a waterslide feature may include a base 402, elevation supports 410, and/or various ride surface supports. The ride surface supports may include an inner ring support 425 and/or outer ring support 420 (e.g., made of metal) that operate to help define and/or support a bottom portion of a ride surface and a plurality of frame elements 427 that conform (e.g., vertically) to an exterior side of the wall surface 435. Although the inner ring support 425 and/or outer ring support 420 are specifically illustrated as having a circular shape, any shape or configuration may be used (e.g., a shape that approximates a portion, such as a bottom portion, of the ride surface may be used in alternative embodiments. The plurality of frame elements 427 may attach to one or more of the inner ring support 425 and/or the outer ring support 420. The inner ring support 425 and/or the outer ring support 420 may be connected with the elevation supports 410 (e.g., at a central position under the ride surface). The elevation supports 410 may then be connected with the base 402. An upper ring support 429 may be disposed at or near a top portion of the wall surface 435 for providing support to the wall surface 435 and/or frame elements 427.

The elevation supports 410 and/or the base 402 may be used to tilt the ride surface or other portions of the waterslide feature by having elevation supports 410 of different lengths. The entrance 411 and/or the exit 412 may pass through one or more portions of the supporting frame for the waterslide feature, such as through adjacent frame elements 427 and/or through the inner ring support 425, outer ring support 420, and/or elevation supports 410 as desired. In the event the waterslide feature comprises a ride surface that defines a ride path that is non-parallel or oblique to the ground, the wall surface 435 may be configured to compensate for the offset and maintain a barrier between a rideable portion of the waterslide feature and any exterior environment surrounding the waterslide feature. For example, as shown in FIG. 4C, the wall surface 435 may include an upward extension 465 of an additional height (e.g., a height extending above the upper ring support 429), for example, to compensate for a lower height of a portion of the ride surface and/or may extend toward a center of the waterslide feature to define an overhang or ledge. This upward extension 465 may help act as a barrier against the exterior environment from encroaching or otherwise undesirably interfering with a particular portion of the waterslide feature or its surfaces.

Exemplary embodiments of a waterslide features are described throughout this application. Although particular embodiments are described and/or shown in terms of a water ride attraction and/or water slide, embodiments are not so limited. Exemplary embodiments may be used with water in which a rider goes down a flume and into an embodiment of the waterslide feature according to embodiments described herein on a sheet or layer of water. The rider may ride directly on the water through the flume and/or waterslide feature, or may ride a raft, inflatable, board, or other vehicle or surface. In an exemplary embodiment, the vehicle may support a plurality of riders. Exemplary embodiments may be used without water, and provide an amusement attraction for riding by one or more riders without water.

A waterslide feature may have any combination of additional features as described throughout this application. For example, one or more of the following features for a waterslide feature and/or its supporting structure or configuration may be a part of any of a variety of possible embodiments. At least one of an entrance or an exit to a waterslide feature may be a flume (e.g., open or closed flume). A ride surface may be in the shape of a tilted bowl. A ride surface may include a guide for maintaining a rider on a predetermined area or path of the ride surface as the rider moves along a travel path (e.g., a looping or arcuate travel path). Such a guide may be configured with the travel path including at least one of materials and coatings with different coefficients of friction to cause the rider to be maintained in a predetermined area of the ride surface.

A flume may be provided as at least one of an entrance and/or an exit for a waterslide feature. A ride surface may be in the shape of a bowl and/or may be connected with the entrance and the exit. Inclined walls may be connected with and/or extend directly upwardly from the ride surface (e.g., to fully or partially enclose the ride surface). This may allow a rider to ride thereon and/or separate the rider from an exterior environment that may be seen and/or experienced through transparent and/or semi-transparent materials making up all or some portion of the ride surface.

An entrance and/or an exit may be connected with a ride surface at substantially a lowest elevation of the ride surface. A ride surface may extend above the lowest elevation of the ride surface. A top portion of the ride surface may be positioned above the lowest elevation of the ride surface. At least one of an entrance or an exit may be a flume. A ride surface may be in the shape of a tilted bowl. A ride surface may include a guide, channel, or other structure or component for maintaining the rider on a predetermined area or travel path of the ride surface as the rider moves along the travel path. Such a guide may be defined by an interior perimeter and an exterior perimeter, the interior perimeter and exterior perimeter defining a variable width along the length of the guide. Such interior perimeter and/or exterior perimeter may be defined by elevated and/or recessed portions of the ride surface to define the guide. Moreover, such variable width may be a minimum at or near an entrance and/or an exit to the ride surface. The interior perimeter may define a first ovoid shape and the exterior perimeter may define a second ovoid shape, the same or different from the first ovoid shape.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any other combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto. When used in this specification and claims, the terms "comprises" and "comprising" and variations thereof mean that the specified features, steps or integers are included. The terms are not to be interpreted to exclude the presence of other features, steps or components.

The invention claimed is:

1. A waterslide comprising:

a body of water; and a waterslide feature including:

a surface defining a concave curvature across a first cross section of the waterslide feature, and the surface defining multiple curvatures across a second cross section of the waterslide feature, the multiple curvatures including two concave and a convex shape, wherein the convex shape of the multiple curvatures creates an edge of an elevated portion, an entrance, an exit, and a ride surface connecting the entrance and the exit, wherein the ride surface is created by at least a portion of the concave curvature, the multiple curvatures, or a combination thereof, the ride surface is configured to direct a rider from the entrance to the exit along an arcuate travel path on the ride surface, a width of the ride surface changes along the arcuate travel path to create an enlarged area for a potential arcuate travel path of the rider about a full 360 degrees, wherein the width of the ride surface is at a minimum at or near the entrance and the exit to the ride surface, wherein the waterslide feature is at least partially disposed beneath a surface of the body of water such that the ride surface for the potential arcuate travel path is fully under a level of the surface of the body of water.

2. The waterslide of claim 1 wherein the ride surface is at least partially formed of a transparent material, at least a portion of the transparent material being positioned beneath the surface of the body of water.

3. The waterslide of claim 1 wherein the body of water surrounds the waterslide feature such that the ride surface is disposed within a volume defined by the body of water.

4. The waterslide of claim 3 wherein the body of water is a pool.

5. The waterslide of claim 3 wherein the body of water is a lake.

6. The waterslide of claim 3 further comprising a wall extending directly and upwardly from the ride surface at a perimeter of the ride surface.

7. The waterslide of claim 6 wherein at least a portion of the wall extends above the surf ace of the body of water.

8. The waterslide of claim 7 wherein the wall is curved concave inward toward a center of the waterslide feature.

9. A waterslide comprising:

a body of water; and a waterslide feature including:

a surface defining a concave curvature across a first cross section of the waterslide feature, and multiple curvatures across a second cross section of the waterslide feature, the multiple curvatures including two concave and a convex shape, wherein the convex shape of the multiple curvatures of the surface creates an edge of an elevated portion, an entrance, an exit, and a ride surface defined by at least a portion of the concave curvature, the multiple curvatures, or a combination thereof and connecting the entrance and the exit, the ride surface at least partially made of a transparent material and wherein the ride surface is configured to direct a rider from the entrance to the exit along an arcuate travel path on the ride surface, a width of the ride surface changes along the arcuate travel path to create an enlarged area for a potential arcuate travel path of the rider about at least 270 degrees, wherein the width of the ride surface is at a minimum at or near the entrance and the exit to the ride surface, wherein the waterslide feature is at least partially disposed beneath a surface of the body of water such that the ride surface for the potential arcuate travel path is fully under a level of the surface of the body of water.

10. The waterslide of claim 9 wherein the transparent material is acrylic.

11. The waterslide of claim 9 wherein the exit is a flume disposed under the surface of the body of water that is connected with the ride surface.

12. The waterslide of claim 9 wherein the waterslide feature further comprises a wall connected with the ride surface, wherein at least a portion of the body of water is permitted to flow over the wall and make contact with the ride surface.

* * * * *